US010843214B2

(12) United States Patent
Ophardt et al.

(10) Patent No.: US 10,843,214 B2
(45) Date of Patent: Nov. 24, 2020

(54) VALVE RETENTION UNDER PRESSURE

(71) Applicant: OP-Hygiene IP GmbH, Niederbipp (CH)

(72) Inventors: Heiner Ophardt, Arisdorf (CH); Andrew Jones, St. Anns (CA)

(73) Assignee: OP-Hygiene IP GmbH, Niederbipp (CH)

( * ) Notice: Subject to any disclaimer, the term of this patent is extended or adjusted under 35 U.S.C. 154(b) by 0 days.

(21) Appl. No.: 16/686,483

(22) Filed: Nov. 18, 2019

(65) Prior Publication Data

US 2020/0171525 A1 Jun. 4, 2020

(30) Foreign Application Priority Data

Nov. 29, 2018 (CA) ..... 3025843

(51) Int. Cl.
*B05B 11/00* (2006.01)

(52) U.S. Cl.
CPC ..... *B05B 11/3067* (2013.01); *B05B 11/3001* (2013.01)

(58) Field of Classification Search
CPC . B05B 11/3067; B05B 11/3001; B05B 11/30; B05B 11/3087; B05B 11/3088; B05B 11/309; B05B 11/3011; B05B 11/3014; B05B 11/3038; B05B 11/0005; B05B 11/3066; B05B 11/3018; B05B 11/3019; B05B 11/3064
USPC ..... 222/321.3; 251/331, 328
See application file for complete search history.

(56) References Cited

U.S. PATENT DOCUMENTS 4,967,937 A * 11/1990 von Schuckmann ..... B05B 11/3001 222/136
5,152,434 A * 10/1992 Birmelin ..... B05B 11/3001 222/207
5,165,577 A 11/1992 Ophardt
5,282,552 A 2/1994 Ophardt
5,429,275 A * 7/1995 Katz ..... B05B 11/0075 222/108
5,676,277 A 10/1997 Ophardt
5,813,571 A * 9/1998 Gaucher ..... B05B 11/3023 222/95
5,975,360 A 11/1999 Ophardt
6,021,924 A * 2/2000 Suck ..... B05B 11/3023 222/105

(Continued)

*Primary Examiner* — Benjamin R Shaw
(74) *Attorney, Agent, or Firm* — Thorpe North & Western LLP

(57) ABSTRACT

A one-way valve assembly including a chamber forming body and a valve forming body. The chamber forming body has an opening that extends along an axis and a radially outwardly directed catch surface. The valve forming body extends through the opening, and has an inner sealing disc that is positioned axially inwardly from the opening and has a radially inwardly directed catching surface. The disc is movable between a closed position and an open position. When the sealing disc is at the closed position, the catching surface is positioned radially outwardly from the catch surface in radial alignment with the catch surface so that, if the catching surface were forced radially inwardly, the catch surface would engage with the catching surface to prevent the catching surface from passing axially outwardly through the opening.

20 Claims, 11 Drawing Sheets

(56) References Cited

U.S. PATENT DOCUMENTS

| | | | | |
|---|---|---|---|---|
| 6,045,008 | A * | 4/2000 | Gonzalez Fernandez | B05B 11/306 222/153.13 |
| 6,082,586 | A * | 7/2000 | Banks | A47K 5/14 222/95 |
| 6,230,935 | B1 * | 5/2001 | Mack | B05B 11/007 222/137 |
| 6,880,731 | B2 * | 4/2005 | Heukamp | B05B 11/0078 222/321.7 |
| 6,962,273 | B2 * | 11/2005 | Masuda | B05B 11/3023 222/321.9 |
| 7,267,251 | B2 * | 9/2007 | Ophardt | B05B 11/3001 222/321.9 |
| 2004/0094578 | A1 * | 5/2004 | Bougamont | B05B 11/3035 222/209 |
| 2007/0045349 | A1 * | 3/2007 | Foster | B05B 11/3023 222/321.9 |
| 2007/0256748 | A1 * | 11/2007 | Brahim | B05B 11/3067 137/854 |
| 2007/0257064 | A1 * | 11/2007 | Ophardt | B05B 11/3069 222/251 |
| 2007/0284394 | A1 * | 12/2007 | Ophardt | B05B 11/3001 222/321.7 |
| 2008/0000933 | A1 * | 1/2008 | Marelli | B05B 11/3067 222/321.7 |
| 2012/0104051 | A1 * | 5/2012 | Ophardt | B05B 11/3097 222/321.6 |
| 2012/0132668 | A1 * | 5/2012 | Ophardt | A47K 5/1207 222/1 |
| 2014/0231463 | A1 * | 8/2014 | Goettke | B05B 11/3001 222/321.7 |
| 2016/0332181 | A1 * | 11/2016 | DeMan | B05B 11/3001 |
| 2019/0299228 | A1 * | 10/2019 | Ophardt | A47K 5/16 |

* cited by examiner

VALVE RETENTION UNDER PRESSURE

FIELD OF THE INVENTION

This invention relates to one-way valves that permit fluid flow in one direction and prevent fluid flow in the opposite direction, and more particularly to one-way valve assemblies for hand cleaning fluid dispensers.

BACKGROUND OF THE INVENTION

Fluid dispensers for dispensing hand cleaning fluid often incorporate a one-way valve that permits fluid to be drawn into a fluid pump from a fluid reservoir, and prevents the fluid from being expelled back into the fluid reservoir from the fluid pump. For example, U.S. Pat. No. 7,267,251 to Ophardt, issued Sep. 11, 2007, discloses a one-way valve in the form of a shouldered button with a circular resilient flexing disc extending radially from the button, which is secured in a snap fit inside a central opening of a piston pump chamber. The flexing disc is sized to circumferentially abut the chamber wall of the pump chamber, substantially preventing fluid flow upstream therepast from the pump chamber to a fluid reservoir, and is deflectable away from the chamber wall to permit fluid flow downstream from the fluid reservoir into the pump chamber.

The flexing disc has a larger diameter than the central opening, which under normal operating conditions prevents the disc from being expelled upstream through the opening. However, under certain circumstances the disadvantage arises that the pressure within the piston pump chamber can rise high enough to deform the flexing disc radially inwardly and push the disc upstream through the opening, thus rendering the fluid dispenser inoperable. This can occur, for example, if a user activates the fluid dispenser very forcefully, causing a rapid increase in the pressure within the pump chamber above pressures experienced under normal operating conditions.

SUMMARY OF THE INVENTION

To at least partially overcome some of the disadvantages of previously known devices, the present invention provides a one-way valve assembly with an improved retaining feature. The one-way valve assembly of the present invention represents an improvement over the one-way valve disclosed in U.S. Pat. No. 7,267,251 to Ophardt, issued Sep. 11, 2007, which is incorporated herein by reference.

In accordance with the invention, the one-way valve assembly includes a chamber forming body and a valve forming body, the valve forming body extending along an axis through an opening in the chamber forming body. The valve forming body has a sealing disc that is positioned axially inwardly from the opening, the sealing disc having a radially inwardly directed catching surface. The valve forming body is movable between a closed position, in which a sealing surface of the sealing disc sealingly engages with a seal surface of the chamber forming body to prevent fluid flow therepast, and an open position, in which the sealing surface is spaced axially inwardly from the seal surface to allow fluid to flow therepast. When the valve forming body is at the closed position, the radially inwardly directed catching surface is positioned radially outwardly from a radially outwardly directed catch surface of the chamber forming body and in radial alignment with the catch surface so that, if the catching surface were forced radially inwardly, the catch surface would engage with the catching surface to prevent the sealing disc from passing axially outwardly through the opening.

The inventors have appreciated that the radially inwardly directed catching surface of the valve forming body and the radially outwardly directed catch surface of the chamber forming body advantageously serve as a retaining mechanism that prevents the valve forming body from being expelled axially outwardly through the opening. The one-way valve assembly is thus able to remain functional and intact, even when subjected to unusually high pressures.

Advantageously, the catching surface and the catch surface can be integrally formed as part of the valve forming body and the chamber forming body, respectively, without requiring any additional components that might otherwise increase the complexity and cost of the valve assembly. For example, the catching surface can be provided by selecting the shape of the sealing disc so as to incorporate an axially outwardly extending annular ridge, the ridge having a radially inwardly directed side surface to serve as the catching surface. The catch surface can likewise be provided by selecting the shape of the chamber forming body so as to incorporate an axially inwardly extending annular ridge, the ridge having a radially outwardly directed side surface to serve as the catch surface.

The inventors have appreciated that by directing the catching surface radially inwardly and the catch surface radially outwardly, the catch surface is able to exert a radially outwardly directed retaining force against the catching surface to counter a force pushing the sealing disc radially inwardly towards the central opening when the fluid pressure within the pump chamber is very high.

With this arrangement of the catching surface and the catch surface, the retention of the valve forming body within the opening is primarily dependent on its material strength rather than its rigidity. For this reason, the valve forming body can be made from thinner, softer, and more flexible materials. This can result in lower material costs, and in embodiments where the valve forming body must deform to allow fluid to flow therepast, decreases the amount of force require to open the valve. This can make the fluid dispenser easier to operate, allow for the use of lighter return springs, and improve battery life in embodiments in which the dispenser is activated electronically.

The catching surface and the catch surface can be incorporated into the valve assembly without interfering with its effectiveness at preventing fluid flow in one direction and allowing fluid flow in the opposite direction. In some preferred embodiments, the catching surface and the catch surface can also serve as the sealing surface and the seal surface, respectively.

Accordingly, in one aspect the present invention resides in a one-way valve assembly comprising:

a chamber forming body that at least partially defines a variable pressure fluid compartment, the chamber forming body having an opening that extends through an outer wall of the chamber forming body along an axis; and a valve forming body that extends through the opening, the valve forming body including:

an outer retaining portion that is positioned axially outwardly from the opening and engages with a retaining surface of the chamber forming body to prevent the outer retaining portion from passing axially inwardly through the opening into the variable pressure fluid compartment; and an inner sealing disc that is positioned axially inwardly from the opening, the inner sealing disc having a radially inwardly directed catching surface;

wherein a sealable pathway is defined between the chamber forming body and the valve forming body, the sealable pathway providing a path for fluid to flow from a fluid reservoir into the variable pressure fluid compartment;

wherein the inner sealing disc is movable relative to the chamber forming body between a closed position, in which a sealing surface of the inner sealing disc sealingly engages with a seal surface of the chamber forming body to close the sealable pathway, and an open position, in which the sealing surface is spaced axially inwardly and away from the seal surface of the chamber forming body to open to sealable pathway;

wherein the variable pressure fluid compartment has an internal fluid pressure that varies between a first pressure range, in which the internal fluid pressure is lower than a fluid pressure of the fluid reservoir, and a second pressure range, in which the internal fluid pressure is higher than the fluid pressure of the fluid reservoir;

wherein, when the internal fluid pressure of the variable pressure fluid compartment is in the first pressure range, a pressure differential between the variable pressure fluid compartment and the fluid reservoir forces the inner sealing disc to the open position, allowing the fluid to flow through the sealable pathway from the fluid reservoir into the variable pressure fluid compartment;

wherein, when the internal fluid pressure of the variable pressure fluid compartment is in the second pressure range, the pressure differential between the variable pressure fluid compartment and the fluid reservoir forces the inner sealing disc to the closed position, preventing the fluid from flowing through the sealable pathway from the variable pressure fluid compartment towards the fluid reservoir;

wherein the chamber forming body has a radially outwardly directed catch surface that is positioned radially outwardly from the opening; and wherein, when the inner sealing disc is at the closed position, the catching surface is positioned radially outwardly from the catch surface in radial alignment with the catch surface so that, if the catching surface were forced radially inwardly, the catch surface would engage with the catching surface to prevent the inner sealing disc from passing axially outwardly through the opening.

In preferred embodiments, the outer wall of the chamber forming body has an annular chamber ridge that is positioned axially inwardly and radially outwardly from the opening and extends coaxially about the opening, the annular chamber ridge having a radially inwardly directed first chamber side surface and a radially outwardly directed second chamber side surface, the radially outwardly directed second chamber side surface comprising the catch surface;

wherein the outer wall of the chamber forming body defines an annular chamber recess that is positioned radially outwardly from the catch surface;

wherein the inner sealing disc has an annular valve ridge that is positioned radially outwardly from the opening and extends coaxially about the opening, the annular valve ridge having a radially inwardly directed first valve side surface and a radially outwardly directed second valve side surface, the radially inwardly directed first valve side surface comprising the catching surface;

wherein the inner sealing disc defines an annular valve recess that is positioned radially inwardly from the catching surface; and wherein, when the inner sealing disc is at the closed position, the annular valve ridge is received within the annular chamber recess, with the catching surface engaged with the catch surface, and the annular chamber ridge is received within the annular valve recess.

Preferably, the inner sealing disc comprises a central portion that is positioned axially inwardly from the opening, and a distal edge portion that is positioned axially inwardly and radially outwardly from the opening, the catching surface being positioned on the distal edge portion;

wherein, if the internal fluid pressure of the variable pressure fluid compartment is in the second pressure range and the pressure differential between the variable pressure fluid compartment and the fluid reservoir begins pushing the central portion axially outwardly towards the opening, the engagement of the catching surface with the catch surface prevents the distal edge portion from being expelled axially outwardly through the opening.

In some embodiments, when the internal fluid pressure of the variable pressure fluid compartment is in the first pressure range, the pressure differential between the variable pressure fluid compartment and the fluid reservoir pushes the catching surface axially inwardly and out of engagement with the catch surface.

Optionally, the sealing surface comprises the catching surface, and the seal surface comprises the catch surface.

In some preferred embodiments, the catching surface is directed radially inwardly and axially outwardly, and the catch surface is directed radially outwardly and axially inwardly. In other preferred embodiments, the catching surface is directed radially inwardly and axially inwardly, and the catch surface is directed radially outwardly and axially outwardly.

Optionally, the inner sealing disc is flexible.

The chamber forming body may, for example, comprise a piston chamber forming body that receives a piston forming element therein, the piston forming element being reciprocally movable along the axis relative to the piston chamber forming body to increase or decrease a volume of the variable pressure fluid compartment;

wherein movement of the piston forming element axially outwardly relative to the piston chamber forming body reduces the volume of the variable pressure fluid compartment, which causes the internal fluid pressure to increase to the second pressure range; and wherein movement of the piston forming element axially inwardly relative to the piston chamber forming body increases the volume of the variable pressure fluid compartment, which causes the internal fluid pressure to decrease to the first pressure range.

Preferably, the fluid comprises a hand cleaning fluid.

In some embodiments, the valve forming body slides axially relative to the opening to move between the closed position and the open position.

Optionally, the inner sealing disc deflects axially relative to a stem portion of the valve forming body to move between the closed position and the open position.

In another aspect, the present invention resides in a fluid dispenser comprising the aforementioned one-way valve assembly.

BRIEF DESCRIPTION OF THE DRAWINGS

Further aspects and advantages of the invention will appear from the following description taken together with the accompanying drawings, in which.

DETAILED DESCRIPTION OF THE DRAWINGS

Figure 1:
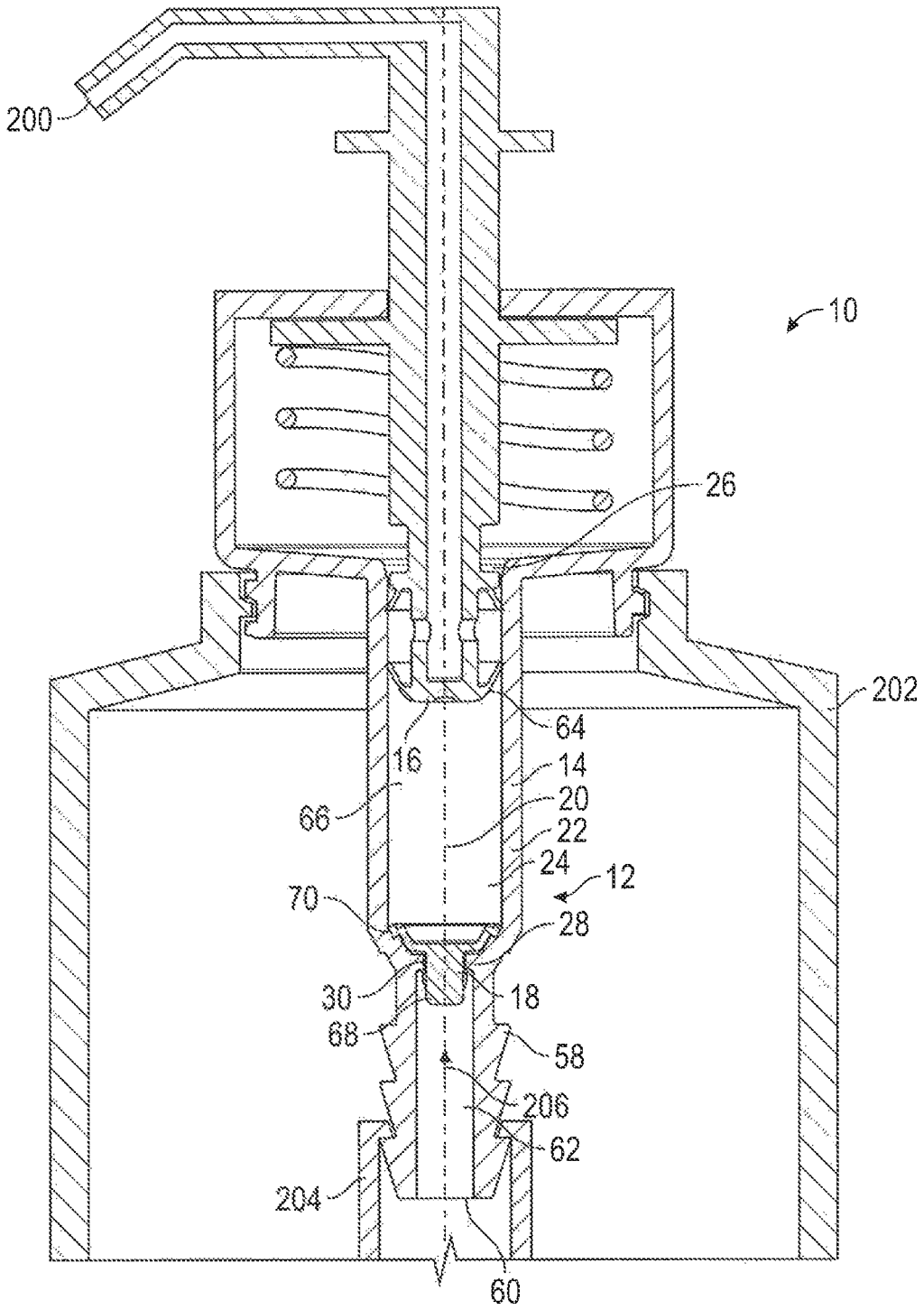
FIG. 1 is a partial cross-sectional view of a fluid dispenser incorporating a one-way valve assembly in accordance with a first embodiment of the present invention.

FIG. 1 shows a partial cross-sectional view of a fluid dispenser 10 incorporating a one-way valve assembly 12 in accordance with a first embodiment of the present invention. The fluid dispenser 10 includes a piston chamber forming body 14, a piston forming element 16, and a valve forming body 18. The piston chamber forming body 14 is disposed coaxially about a center axis 20, and has a cylindrical outer wall 22 that defines a piston pump chamber 24. Fluid flows into the piston pump chamber 24 in an axially inwards direction, as shown by the arrow 206 in FIG. 1. An axially inner end 26 of the piston pump chamber 24 is open for receiving the piston forming element 16 therein.

Figure 3:
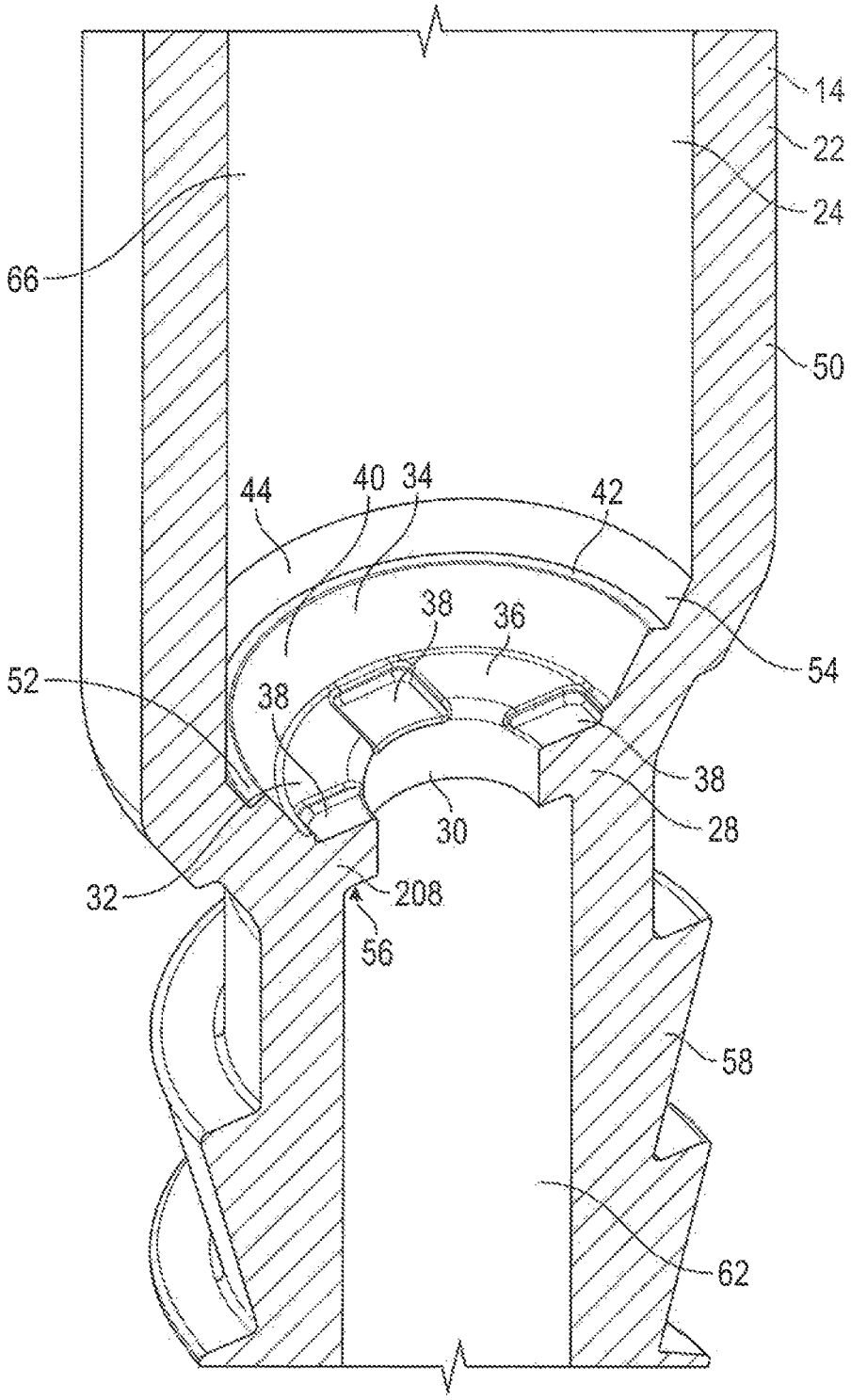
FIG. 3 is a perspective cross-sectional view of the outer end of a piston pump chamber from the one-way valve assembly shown in FIG. 1.

An axially outer end 28 of the piston pump chamber 24 is shown in FIG. 3 as having an end wall 208 with a central opening 30, a first seat portion 32 disposed annularly about the central opening 30, and a second seat portion 34 disposed annularly about the first seat portion 32. The first seat portion 32 has a horizontal and axially inwardly directed top surface 36 with four channel forming recesses 38 that are spaced circumferentially about the central opening 30. Only three of the channel forming recesses 38 are visible in FIG. 3.

Figure 4:
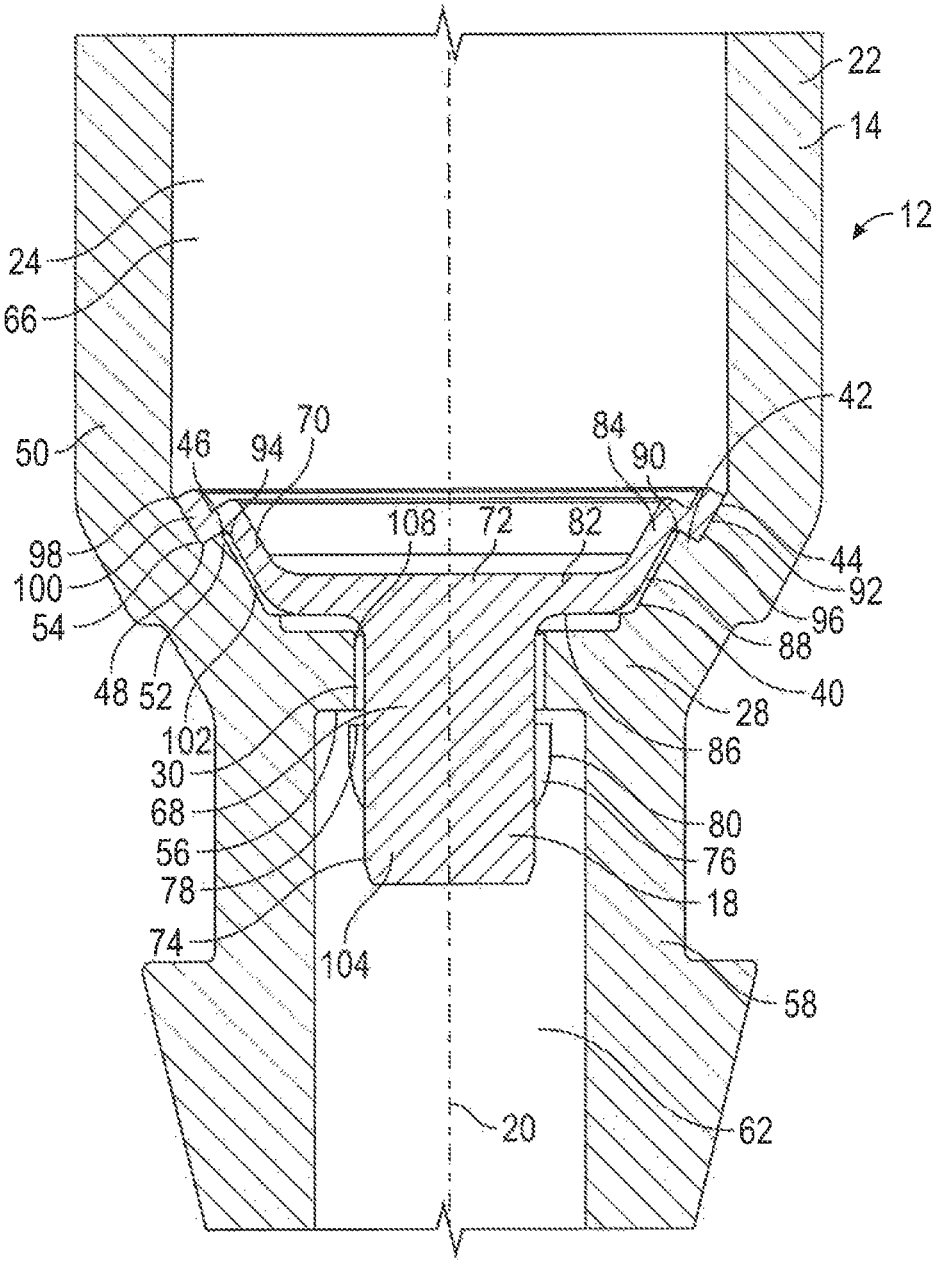
FIG. 4 is an enlarged cross-sectional view of the one-way valve assembly shown in FIG. 1 in a closed position.
Figure 4A:
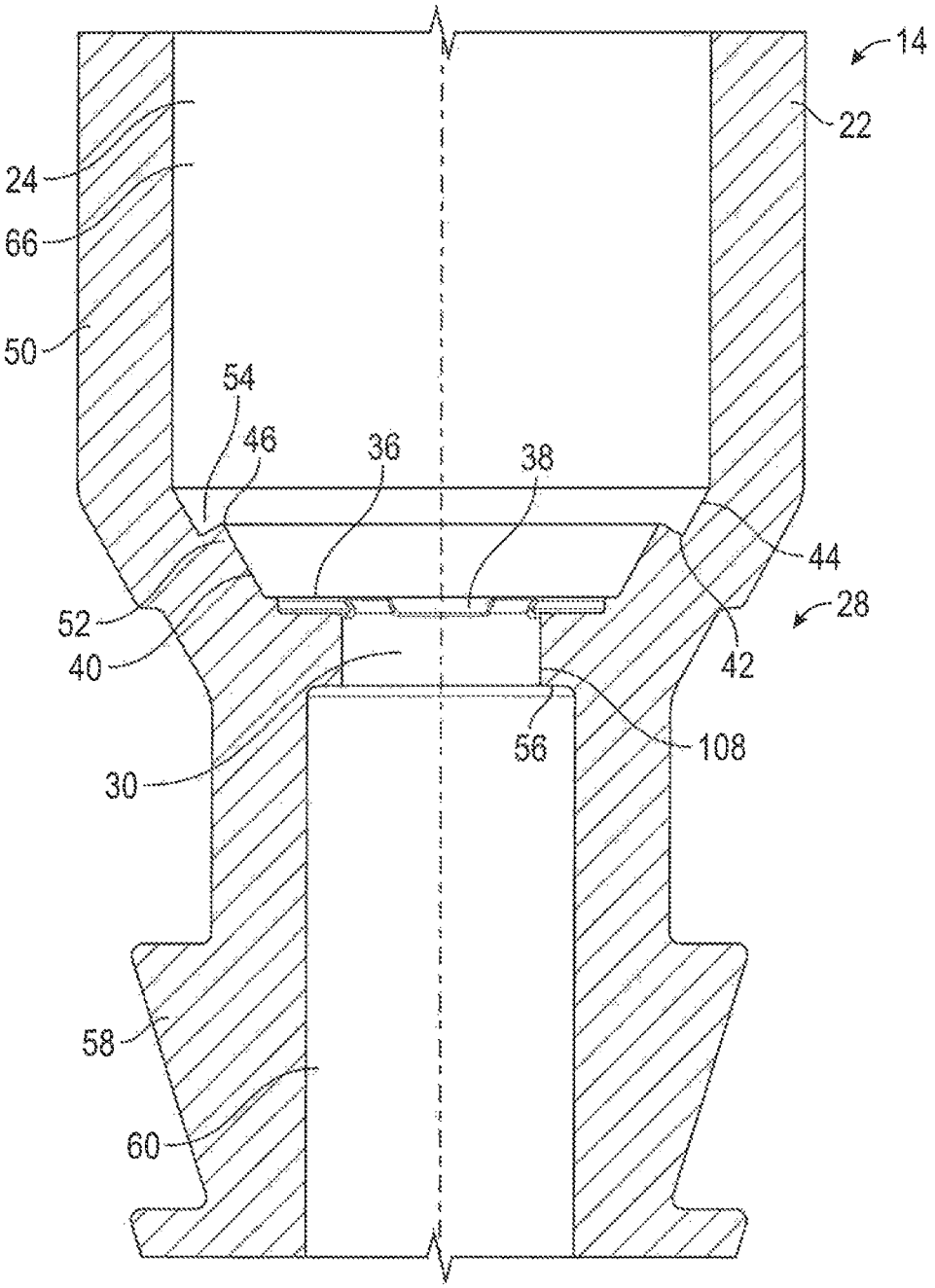
FIG. 4A is an isolated cross-sectional view of the piston pump chamber shown in FIG. 4.
Figure 4B:
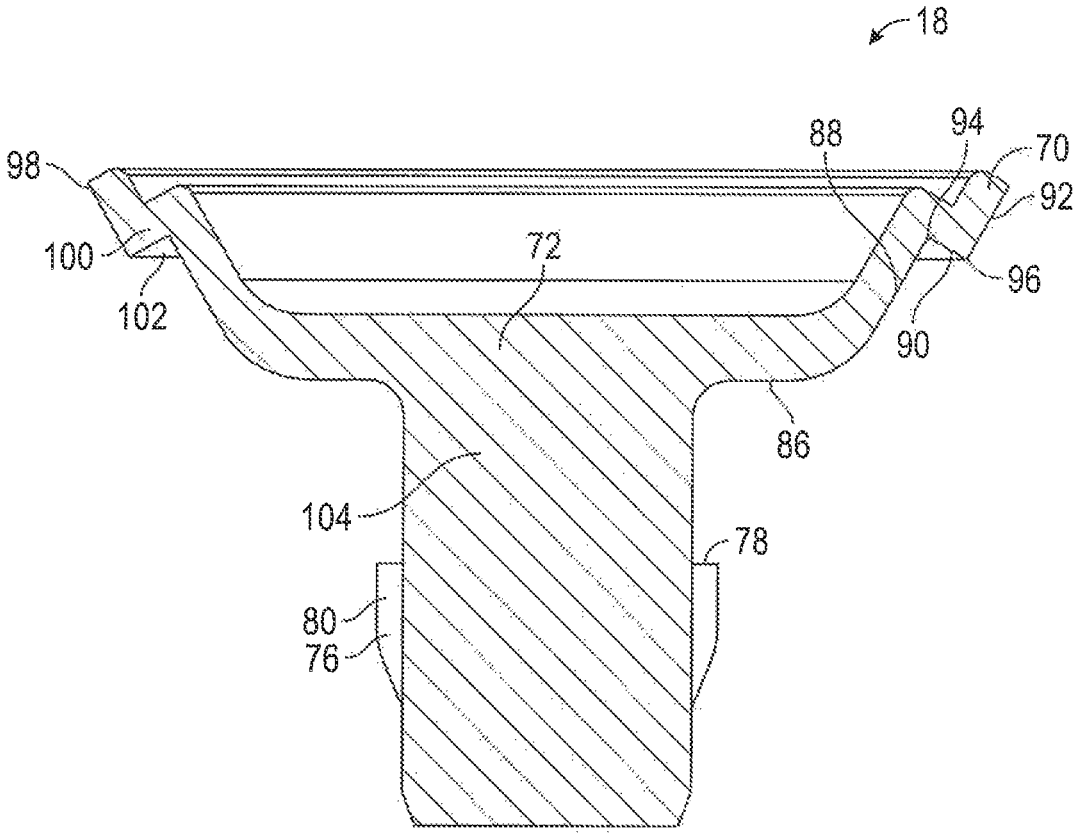
FIG. 4B is an isolated cross-sectional view of the valve forming body shown in FIG. 4.

As best seen in FIG. 4, the second seat portion 34 has a first inclined chamber side surface 40 that faces axially inwardly and radially inwardly, a second inclined chamber side surface 42 that faces axially inwardly and radially outwardly, and a third inclined chamber side surface 44 that faces axially inwardly and radially inwardly. The first side surface 40 extends from the first seat portion 32 up to an upper edge 46 where the first side surface 40 meets the second side surface 42. The second side surface 42 extends from the upper edge 46 down to a bottom corner 48 where the second side surface 42 meets the third side surface 44. The third side surface 44 extends up from the bottom corner 48 to merge with a vertically extending central portion 50 of the cylindrical wall 22 that extends between the inner end 26 and the outer end 28 of the piston pump chamber 24. Together, the first side surface 40 and the second side surface 42 form an annular chamber ridge 52 that extends coaxially about the axis 20 and is spaced radially outwardly from the central opening 30, and the second side surface 42 and the third side surface 44 define an annular chamber recess 54 that extends coaxially about the axis 20 and is positioned radially outwardly from the annular chamber ridge 52.

Axially outwardly from the central opening 30, the piston chamber forming body 14 has a retaining surface 56 that extends horizontally and radially outwardly from the central opening 30. The retaining surface 56 connects to a cylindrical tube forming wall 58 that is disposed coaxially about the center axis 20. The tube forming wall 58 defines a fluid inlet tube 62 that extends axially outwardly from the outer end 28 of the piston pump chamber 24 to an open inlet end 60. The fluid inlet tube 62 extends into a fluid reservoir 202 for drawing hand cleaning fluid from the reservoir 202 into the piston pump chamber 24 upon activation of the dispenser 10. The fluid inlet tube 62 optionally engages with a dip tube 204 that extends to the bottom of the reservoir 202.

The piston forming element 16 is shown in FIG. 1 as extending coaxially into the open inner end 26 of the piston pump chamber 24. The piston forming element 16 has a flexible disc 64 that extends radially outwardly into engagement with the central portion 50 of the cylindrical wall 22 to prevent fluid flow axially outwardly therepast, and is deformable radially inwardly to allow fluid flow axially inwardly therepast. A variable volume and variable pressure fluid compartment 66 is defined between the flexible disc 64 and the outer end 28 of the piston pump chamber 24. The piston forming element 16 is coaxially slidable relative to the piston chamber forming body 14 to increase or decrease the volume of the fluid compartment 66. When the piston forming element 16 slides axially outwardly towards the outer end 28, the volume of the fluid compartment 66 decreases and the fluid pressure within the fluid compartment 66 increases. When the piston forming element 16 slides axially inwardly away from the outer end 28, the volume of the fluid compartment 66 increases and the fluid pressure within the fluid compartment 66 decreases. The piston forming element 16 includes a discharge outlet 200 which is downstream from the flexible disc 64 and discharges fluid from the fluid dispenser 10 when the fluid dispenser 10 is activated. The piston forming element 16 is not limited to any particular construction, and may, for example, have a construction similar to those shown in U.S. Pat. No. 5,165,577 to Ophardt, issued Nov. 24, 1992; U.S. Pat. No. 5,282,552 to Ophardt, issued Feb. 1, 1994; U.S. Pat. No. 5,676,277 to Ophardt, issued Oct. 14, 1997; U.S. Pat. No. 5,975,360 to Ophardt, issued Nov. 2, 1999; and U.S. Pat. No. 7,267,251 to Ophardt, issued Sep. 11, 2007, each of which is incorporated herein by reference.

Figure 2:
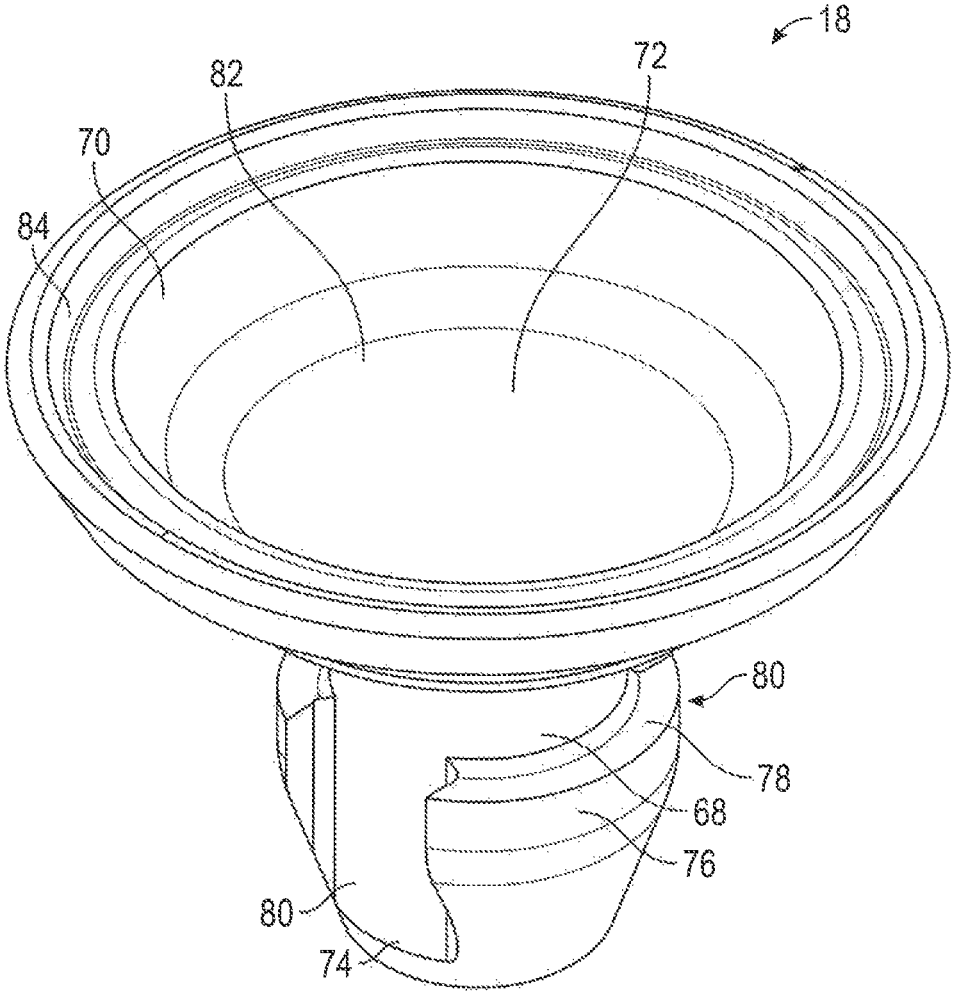
FIG. 2 is a perspective view of a valve forming body from the one-way valve assembly shown in FIG. 1.

The valve forming body 18 is shown in FIG. 2 as having a central stem portion 68 and a sealing disc 70. The central stem portion 68 has a generally cylindrical body that extends axially from an axially inner end 72 to an axially outer end 74, with a center portion 104 therebetween. The outer end 74 of the stem 68 carries a radially outwardly extended outer retaining portion 76, which has an axially inwardly directed retention surface 78. The outer retaining portion 76 has two channel forming recesses 80 that extend axially through the retaining portion 76 on opposite left and right sides. The channel forming recesses 80 reduce the diameter of the retaining portion 76 in the left-to-right direction.

The sealing disc 70 extends radially outwardly from the inner end 72 of the stem 68, and has a central portion or first disc portion 82 disposed annularly about the central stem 68, and a distal edge portion or second disc portion 84 disposed annularly about the first disc portion 82. As shown in FIG.

4, the first disc portion 82 has a generally horizontal bottom surface 86 that faces axially outwardly. The second disc portion 84 has a first inclined valve side surface 88 that faces axially outwardly and radially outwardly, a second inclined valve side surface 90 that faces axially outwardly and radially inwardly, and a third inclined valve side surface 92 that faces axially outwardly and radially outwardly. The first side surface 88 extends from the first disc portion 82 up to an upper corner 94 where the first side surface 88 meets the second side surface 90. The second side surface 90 extends from the upper corner 94 down to a bottom edge 96 where the second side surface 90 meets the third side surface 92. The third side surface 92 extends from the bottom edge 96 up to an outer edge 98 that defines the outer circumference of the sealing disc 70. Together, the second side surface 90 and the third side surface 92 form an annular valve ridge or annular disc ridge 100 that extends coaxially about the axis 20 and is spaced radially outwardly from the central stem 68, and the first side surface 88 and the second side surface 90 define an annular valve recess or annular disc recess 102 that extends coaxially about the axis 20 and is positioned radially inwardly from the annular disc ridge 100.

As shown in FIG. 4, the stem 68 of the valve forming body 18 extends through the central opening 30 of the piston pump chamber 24, with the center portion 104 of the stem 68 positioned within the central opening 30, the outer retaining portion 76 positioned axially outwardly from the central opening 30, and the sealing disc 70 positioned axially inwardly from the central opening 30. Together, the valve forming body 18 and the outer end 28 of the piston pump chamber 24 form the one-way valve assembly 12.

The axial distance between the bottom surface 86 of the sealing disc 70 and the retention surface 78 is greater than the axial distance between the top surface 36 of the first seat portion 32 and the retaining surface 56, and the axial distance between the second valve side surface 90 and the retention surface 78 is greater than the axial distance between the second chamber side surface 42 and the retaining surface 56. This allows the valve forming body 18 to slide axially relative to the piston chamber forming body 14 between the closed position shown in FIG. 4 and the open position shown in FIG. 5.

When the valve forming body 18 is at the closed position, the sealing disc 70 engages with the outer end 28 of the piston pump chamber 24, and the retention surface 78 is spaced axially outwardly from the retaining surface 56. As shown in FIG. 4, the bottom surface 86 of the sealing disc 70 engages with the top surface 36 of the first seat portion 32, and the second valve side surface 90 of the sealing disc 70 engages with the second chamber side surface 42 of the piston chamber forming body 14.

Figure 5:
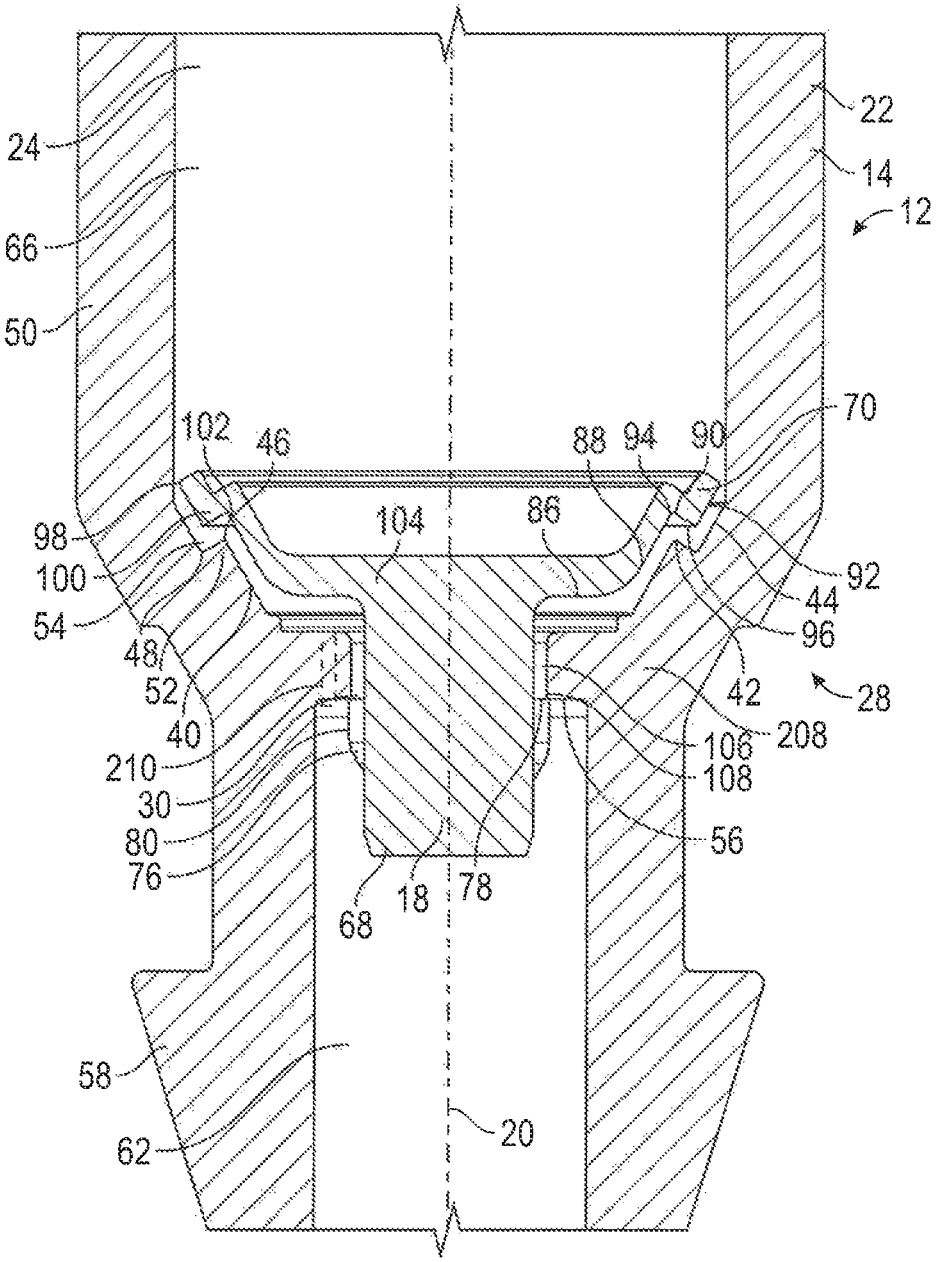
FIG. 5 is an enlarged cross-sectional view of the one-way valve assembly shown in FIG. 1 in an open position.

To move from the closed position to the open position, the valve forming body 18 slides axially inwardly relative to the piston chamber forming body 14. When at the open position, as shown in FIG. 5, the retention surface 78 engages with the retaining surface 56, the bottom surface 86 of the sealing disc 70 is spaced axially inwardly from the top surface 36 of the first seat portion 32, and the second valve side surface 90 is spaced axially inwardly from the second chamber side surface 42. This provides an open fluid pathway 106 between the fluid compartment 66 and the fluid inlet tube 62, the pathway 106 extending axially past the outer retaining portion 76 of the valve forming body 18 through the channel forming recesses 80, between the center portion 104 of the stem 68 and an inner surface 108 of the central opening 30, and between the sealing disc 70 and the first and second seat portions 32, 34 of the piston chamber forming body 14. Alternatively, in other embodiments of the invention the fluid pathway 106 could extend through one or more side channels 210 that extend axially through the end wall 208 and are positioned radially outwardly from the central opening 30, as shown in dotted lines in FIG. 5.

The operation of the valve assembly 12 will now be described with reference to FIGS. 1 to 5. The valve assembly 12 allows fluid to be drawn into the fluid compartment 66 from the fluid inlet tube 62, and prevents the fluid from being discharged back into the fluid inlet tube 62 from the fluid compartment 66. To draw fluid into the fluid compartment 66, the fluid pressure within the compartment 66 is decreased by sliding the piston forming element 16 axially inwardly relative to the piston chamber forming body 14, thereby increasing the volume of the fluid compartment 66 and creating a vacuum within the fluid compartment 66. This creates a pressure differential between the fluid compartment 66 and the fluid inlet tube 62 which forces the valve forming body 18 axially inwardly relative to the piston chamber forming body 14 to the open position as shown in FIG. 5. This opens the fluid pathway 106, allowing the relatively high pressure fluid within the fluid inlet tube 62 to flow through the fluid pathway 106 into the relatively low pressure fluid compartment 66. The engagement of the retention surface 78 with the retaining surface 56 prevents the retaining portion 76 of the valve forming body 18 from being drawn into the fluid compartment 66 through the central opening 30.

Once the fluid has been drawn into the fluid compartment 66, it is dispensed from the fluid dispenser 10 by sliding the piston forming element 16 axially outwardly relative to the piston chamber forming body 14. This decreases the volume of the fluid compartment 66, thereby increasing the fluid pressure within the compartment 66 and forcing the fluid to flow axially inwardly past the flexible disc 64 towards the discharge outlet 200. The increased pressure within the fluid compartment 66 creates a pressure differential between the fluid compartment 66 and the fluid inlet tube 62 which forces the valve forming body 18 axially outwardly relative to the piston chamber forming body 14 to the closed position as shown in FIG. 4.

When at the closed position, the second valve side surface 90 of the sealing disc 70 sealingly engages with the second chamber side surface 42 of the piston chamber forming body 14. This produces a fluid-tight seal that closes the fluid pathway 106 and prevents the fluid within the fluid compartment 66 from passing axially outwardly past the sealing disc 70 and into the fluid inlet tube 62. The second valve side surface 90 thus serves as a sealing surface, and the second chamber side surface 42 serves as a seal surface, which move axially relative to one another between the open position and the closed position to open and close the fluid pathway 106, and thereby allow the fluid to flow from the fluid inlet tube 62 to the fluid compartment 66, and prevent the fluid from flowing from the fluid compartment 66 back into the fluid inlet tube 62.

In some embodiments of the invention, the valve forming body 18 may become misaligned with the axis 20 when in the open position, with one side of the disc 70 being spaced further from the axis 20 than the other side. If the valve forming body 18 becomes misaligned, the third valve side surface 92 on the side of the disc 70 that is spaced further from the axis 20 will contact the third chamber side surface 44 as the valve forming body 18 moves axially outwardly towards the closed position. The engagement of the third valve side surface 92 with the third chamber side surface 44 moves the side of the disc 70 that is spaced further from the axis 20 radially inwardly towards the axis 20, and thus guides the valve forming body 18 towards axial alignment. The valve forming body 18 is thus self-centering as it moves from the open position of FIG. 5 to the closed position of FIG. 4.

As can be seen in FIG. 4, when the valve forming body 18 is at the closed position, the annular chamber ridge 52 extends into the annular disc recess 102, and the annular disc ridge 100 extends into the annular chamber recess 54. This positions the second valve side surface 90 radially outwardly from the second chamber side surface 42 and in radial alignment with and in opposition to the second chamber side surface 42. The term "radial alignment" as used herein refers to a positioning of the second valve side surface 90 relative to the second chamber side surface 42 wherein there is at least one plane extending perpendicularly from the axis 20 that would intersect both the second valve side surface 90 and the second chamber side surface 42. In other words, the second valve side surface 90 is positioned at an axial height relative to the second chamber side surface 42 that causes the axial extent of the second valve side surface 90 to at least partially overlap with the axial extent of the second chamber side surface 42. The second chamber side surface 42 is thus interposed between the second valve side surface 90 and the central opening 30, and prevents the second valve side surface 90 from moving radially inwardly past the second chamber side surface 42 towards the central opening 30 when the valve forming body 18 is at the closed position.

Under some circumstances, such as when a user manually activates the fluid dispenser 10 very forcefully, the fluid pressure within the fluid compartment 66 may rise high enough to begin forcing the sealing disc 70 axially outwardly through the central opening 30. Because the sealing disc 70 has a larger diameter than the central opening 30, the disc 70 needs to deform radially inwardly in order to pass through the central opening 30. A radially inwardly directed force may be generated if the first disc portion 82 engages with the first seat portion 32 under sufficient pressure that the first disc portion 82 begins to deform axially inwardly and radially inwardly relative to the central stem 68 as the central stem 68 moves axially outwardly through the central opening 30. If a radially inwardly directed force is encountered during operation of the fluid dispenser 10, the second valve side surface 90 will be forced radially inwardly against the second chamber side surface 42. The second chamber side surface 42 will then exert a radially outwardly directed retaining force against the second valve side surface 90 that counterbalances the radially inwardly directed force and prevents the second disc portion 84 of the sealing disc 70 from deforming radially inwardly and passing axially outwardly through the central opening 30. The second valve side surface 90 thus acts as a catching surface, and the second chamber side surface 42 acts as a catch surface, whose engagement prevents the sealing disc 70 from being expelled axially outwardly through the central opening 30.

The second valve side surface 90 and the second chamber side surface 42 have an overlapping axial extent that prevents the catching surface 90 from moving radially inwardly past the second chamber side surface 42 when the valve forming body 18 is at the closed position, as shown in FIG. 4, but not when the valve forming body 18 is at the open position, as shown in FIG. 5. The valve forming body 18 must therefore be prevented from moving to the open position when the pressure within the fluid compartment 66 is high, in order for the engagement of the second valve side surface 90 with the second chamber side surface 42 to prevent the sealing disc 70 from being expelled through the central opening 30.

The valve forming body 18 is prevented from moving to the open position when the fluid pressure within the fluid compartment 66 is high because the pressure that pushes the sealing disc 70 axially outwardly towards the central opening 30 also forces the annular disc ridge 100 axially outwardly into the annular chamber recess 54. The high pressure thus prevents the valve forming body 18 from moving towards the open position, and maintains the overlapping axial extent of the second valve side surface 90 and the second chamber side surface 42 whenever the sealing disc 70 is at risk of being expelled out through the central opening 30 because of high pressure within the fluid compartment 66. As the force pushing the annular disc ridge 100 axially outwardly into the annular chamber recess 54 and the force pushing the sealing disc 70 axially outwardly through the central opening 30 are both produced by the fluid pressure within the fluid compartment 66, the two forces increase in proportion to one another so that the second valve side surface 90 and the second chamber side surface 42 remain locked in engagement even at very high fluid pressures, such as 20 bar or more.

Figure 6:
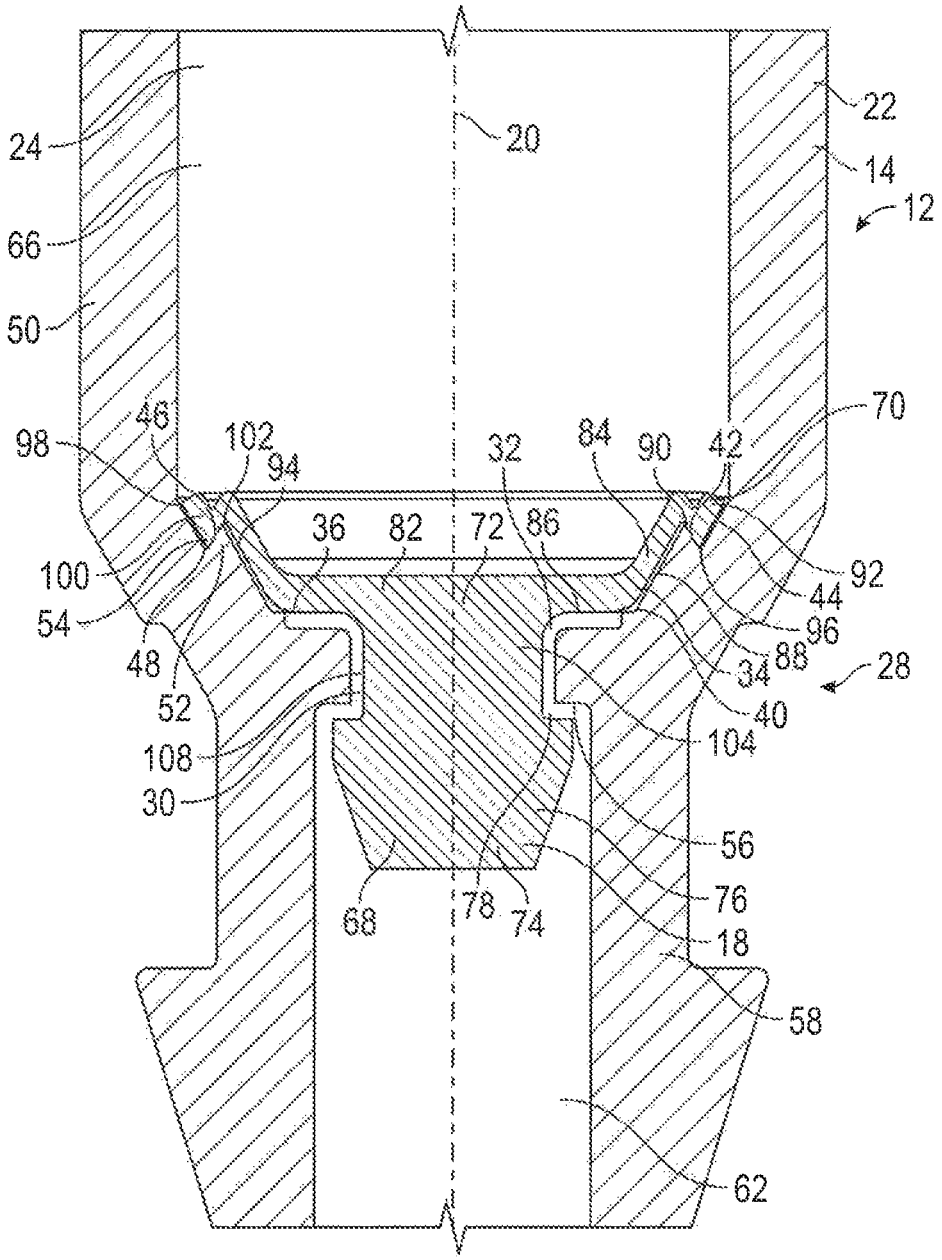
FIG. 6 is an enlarged cross-sectional view of a one-way valve assembly in accordance with a second embodiment of the invention, showing the one-way valve assembly in a closed position.
Figure 7:
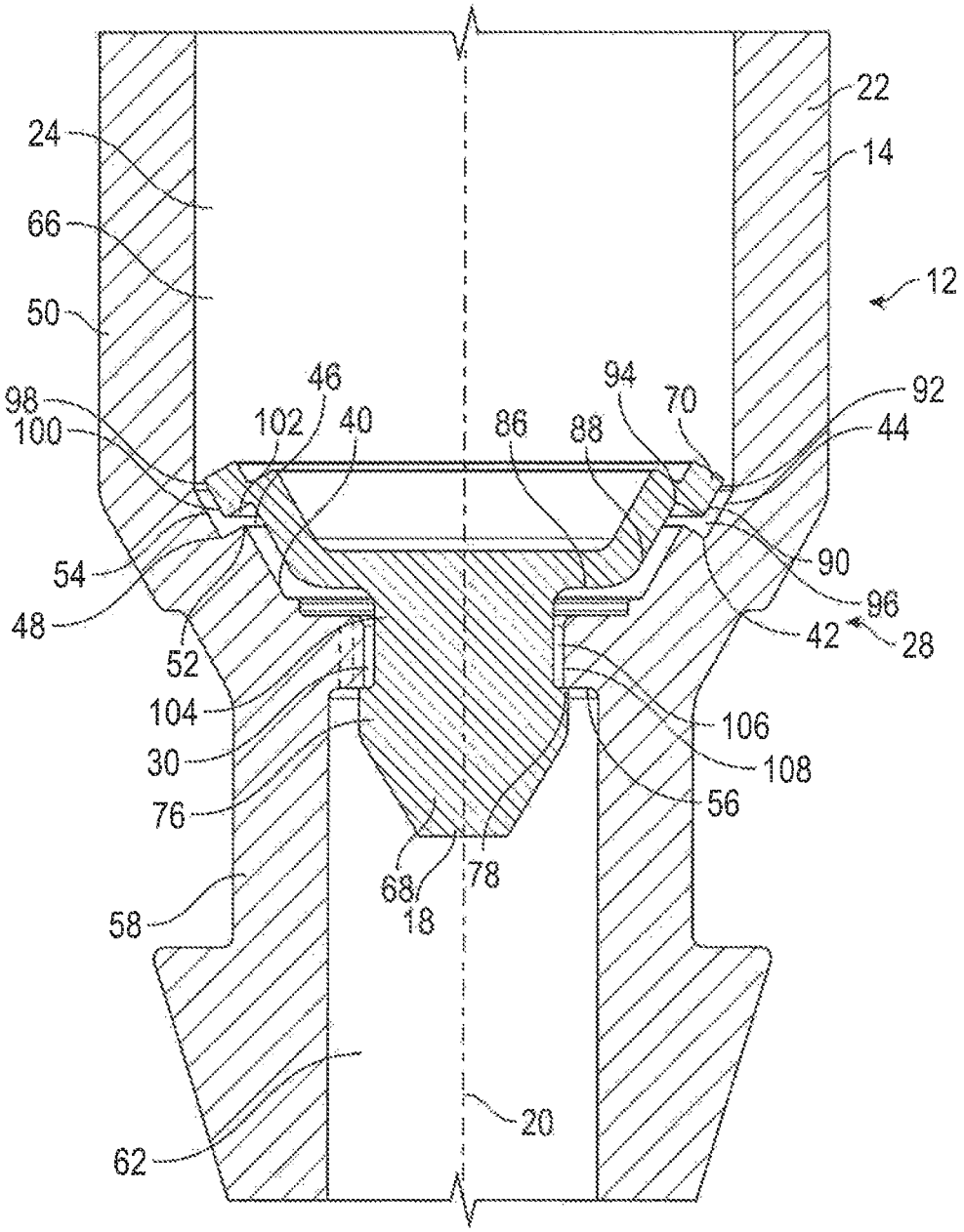
FIG. 7 is an enlarged cross-sectional view of the one-way valve assembly shown in FIG. 6 in an open position.

A one-way valve assembly 12 in accordance with a second embodiment of the invention is shown in FIGS. 6 and 7. The one-way valve assembly 12 shown in FIGS. 6 and 7 is identical to the valve assembly 12 shown in FIGS. 1 to 5, with the exception that the second valve side surface 90 and the second chamber side surface 42 each have a steeper angle of inclination. Although present, the channel forming recesses 80 extending through the retaining portion 76 of the valve forming body 18 are not visible in the cross-sections shown in FIGS. 6 and 7. Like numerals are used to denote like components.

In the embodiment shown in FIGS. 6 and 7, the second valve side surface 90 and the second chamber side surface 42 are each angled about 30 degrees from the axial direction. In contrast, in the embodiment shown in FIGS. 1 to 5 the second valve side surface 90 and the second chamber side surface 42 are each angled about 60 degrees from the axial direction. The steeper angle of inclination in the embodiment shown in FIGS. 6 and 7 can help to maintain the second valve side surface 90 in locked engagement with the second chamber side surface 42, by making it even more difficult for the second valve side surface 90 to slide axially inwardly along the second chamber side surface 42 towards the open position when there is a high fluid pressure within the fluid compartment 66. The second valve side surface 90 and the second chamber side surface 42 can be selected to have any angle that is less the 90 degrees relative to the axial direction, and preferably each have an angle of 60 degrees or less relative to the axial direction.

The valve assembly 12 shown in FIGS. 6 and 7 operates in an identical manner to the assembly 12 shown in FIGS. 1 to 5.

Figure 8:
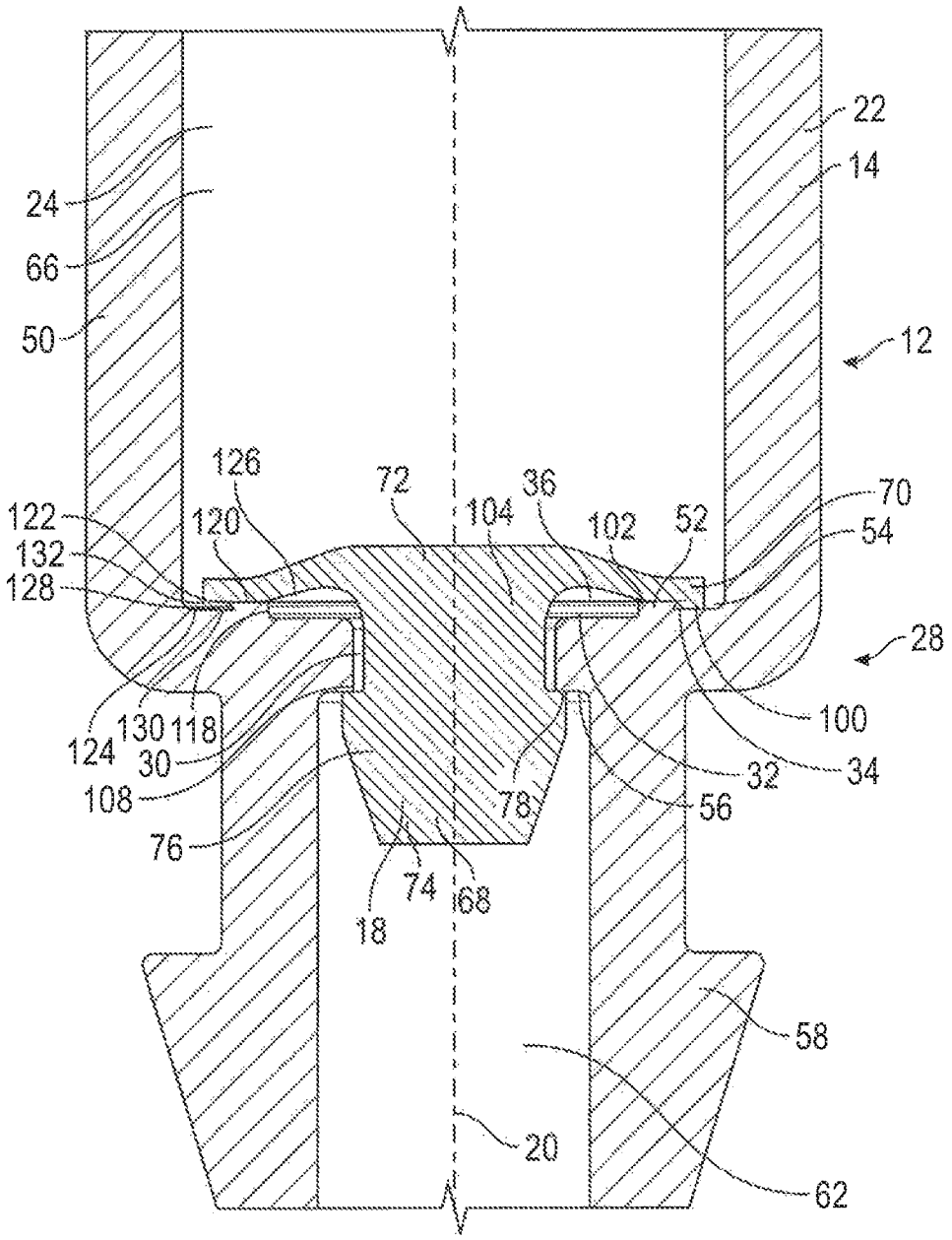
FIG. 8 is an enlarged cross-sectional view of a one-way valve assembly in accordance with a third embodiment of the invention, showing the one-way valve assembly in a closed position.
Figure 9:
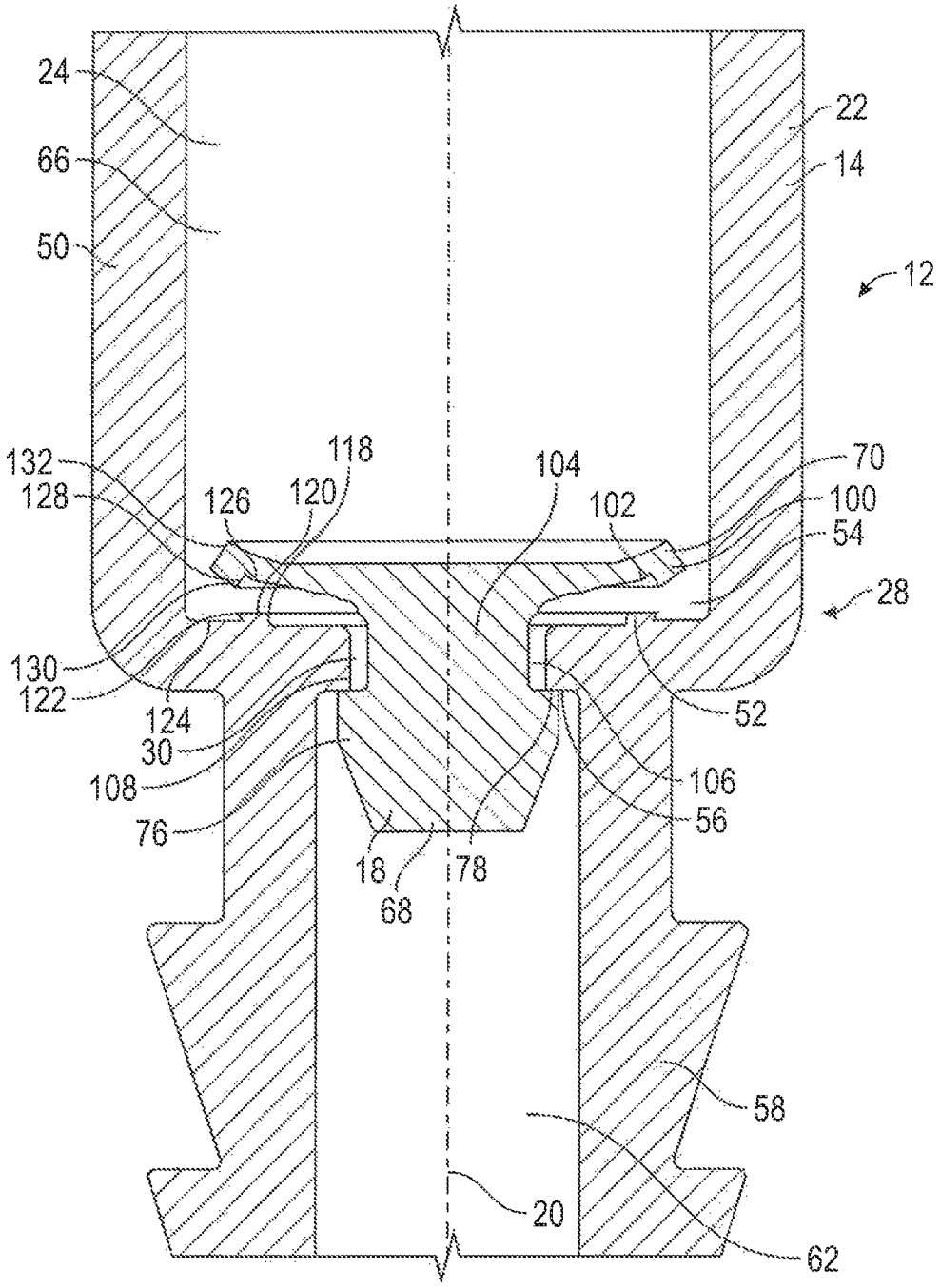
FIG. 9 is an enlarged cross-sectional view of the one-way valve assembly shown in FIG. 8 in an open position.

A one-way valve assembly 12 in accordance with a third embodiment of the invention is shown in FIGS. 8 and 9. In the embodiment shown in FIGS. 8 and 9, the sealing disc 70 is resiliently deformable, and moves from the closed position to the open position by deforming axially inwardly. The one-way valve assembly 12 shown in FIGS. 8 and 9 is generally similar to the assemblies 12 shown in FIGS. 1 to 7, but has a number of structural and functional differences as described below. Like numerals are used to denote like components.

As shown in FIGS. 8 and 9, the axially outer end 28 of the piston pump chamber 24 has a first seat portion 32 and a second seat portion 34. The first seat portion 32 corresponds identically to the first seat portion 32 in the embodiments shown in FIGS. 1 to 7. The second seat portion 34 has a first ridge side surface 118, a ridge top surface 120, a second ridge side surface 122 which serves as the catch surface, and a recess bottom surface 124. The first ridge side surface 118 extends axially inwardly from the first seat portion 32, and the ridge top surface 120 extends radially outwardly from the first ridge surface 118. The second ridge side surface 122 extends axially outwardly and radially inwardly from the ridge top surface 120, and the recess bottom surface 124 extends radially outwardly from the second ridge side surface 122 towards the cylindrical wall 22. Together, the first ridge side surface 118, the ridge top surface 120, and the second ridge side surface 122 form an annular chamber ridge 52 that extends coaxially about the axis 20 and is spaced radially outwardly from the central opening 30. The second ridge side surface 122 and the recess bottom surface 124 define an annular chamber recess 54 that extends coaxially about the axis 20 and is positioned radially outwardly from the annular chamber ridge 52.

As in the embodiments shown in FIGS. 1 to 7, the valve forming body 18 has a central stem portion 68 and a sealing disc 70. The outer end 74 of the central stem portion 68 carries a radially outwardly extended outer retaining portion 76, which has an axially inwardly directed retention surface 78. The outer retaining portion 76 has two channel forming recesses 80 extending axially therethrough, although the channel forming recesses 80 are not visible in the cross-sections shown.

The sealing disc 70 is formed from flexible material, such as silicone, and extends radially outwardly from the inner end 72 of the stem 68. The sealing disc 70 has a recess top surface 126, an inner ridge side surface 128 which serves as the catching surface, a ridge bottom surface 130, and an outer ridge side surface 132. The recess top surface 126 extends radially outwardly from the stem 68, and the inner ridge side surface 128 extends axially outwardly and radially inwardly from the recess top surface 126. The ridge bottom surface 130 extends radially outwardly from the inner ridge side surface 128, and the outer ridge side surface 132 extends axially inwardly from the ridge bottom surface 130. Together, the inner ridge side surface 128, the ridge bottom surface 130, and the outer ridge side surface 132 form an annular disc ridge 100 that extends coaxially about the axis 20 and is spaced radially outwardly from the central stem 68. The recess top surface 126 and the inner ridge side surface 128 define an annular disc recess 102 that extends coaxially about the axis 20 and is positioned radially inwardly from the annular disc ridge 100.

The flexibility of the sealing disc 70 allows it to deform axially upwardly from the closed position as shown in FIG. 8, to the open position as shown in FIG. 9. The retention surface 78 remains engaged with the retaining surface 56 in both the closed and open positions.

When the sealing disc 70 is at the closed position as shown in FIG. 8, the annular disc ridge 100 extends into the annular chamber recess 54, and the annular chamber ridge 52 extends into the annular disc recess 102, with the ridge top surface 120 sealingly engaging with the recess bottom surface 124, the inner ridge side surface 128 sealingly engaging with the second ridge side surface 122, and the ridge bottom surface 130 sealingly engaging with the recess top surface 126.

To move from the closed position to the open position, the sealing disc 70 deforms axially inwardly away from the outer end 28 of the piston pump chamber 24, so that the annular disc ridge 100 is spaced axially inwardly from the annular chamber recess 54, and the annular disc recess 102 is spaced axially inwardly from the annular chamber ridge 52, as shown in FIG. 9. This provides an open fluid pathway 106 between the fluid compartment 66 and the fluid inlet tube 62, the pathway 106 extending axially past the outer retaining portion 76 of the valve forming body 18 through the channel forming recesses 80, between the center portion 104 of the stem 68 and an inner surface 108 of the central opening 30, and between the sealing disc 70 and the first and second seat portions 32, 34 of the piston chamber forming body 14.

As in the embodiments shown in FIGS. 1 to 7, in the embodiment shown in FIGS. 8 and 9 the sealing disc 70 moves between the open and closed positions in response to pressure changes within the fluid compartment 66. When the fluid pressure within the fluid compartment 66 decreases, the resulting pressure differential between the fluid compartment 66 and the fluid inlet tube 62 forces the sealing disc 70 to deform axially inwardly to the open position shown in FIG. 9. This opens the fluid pathway 106, allowing the relatively high pressure fluid within the fluid inlet tube 62 to flow through the fluid pathway 106 into the relatively low pressure fluid compartment 66. The engagement of the retention surface 78 with the retaining surface 56 prevents the retaining portion 76 of the valve forming body 18 from being drawn into the fluid compartment 66 through the central opening 30.

When the fluid pressure within the fluid compartment 66 increases, the resulting pressure differential between the fluid compartment 66 and the fluid inlet tube 62 forces the sealing disc 70 axially outwardly back to the closed position shown in FIG. 8. When at the closed position, the ridge top surface 120 sealingly engaging with the recess bottom surface 124, the inner ridge side surface 128 sealingly engaging with the second ridge side surface 122, and the ridge bottom surface 130 sealingly engaging with the recess top surface 126. This produces a fluid-tight seal that closes the fluid pathway 106 and prevents the fluid within the fluid compartment 66 from passing axially outwardly past the sealing disc 70 and into the fluid inlet tube 62. The recess bottom surface 124, the inner ridge side surface 128, and the ridge bottom surface 130 thus serve as sealing surfaces, and the ridge top surface 120, the second ridge side surface 122, and the recess top surface 126 serve as seal surfaces, which move axially relative to one another between the open position and the closed position to open and close the fluid pathway 106, and thereby allow the fluid to flow from the fluid inlet tube 62 to the fluid compartment 66, and prevent the fluid from flowing from the fluid compartment 62 back into the fluid inlet tube 62.

As can be seen in FIG. 8, when the sealing disc 70 is at the closed position, the inner ridge side surface 128, which serves as the catching surface, is positioned radially outwardly from the second ridge side surface 122, which serves as the catch surface, and the inner ridge side surface 128 is radially aligned with and in opposition to the second ridge side surface 122. As in the embodiments shown in FIGS. 1 to 7, in the embodiment shown in FIGS. 8 and 9 this positioning of the catching surface relative to the catch surface prevents the sealing disc 70 from being deformed radially inwardly and expelled axially outwardly through the central opening 30 when the fluid pressure within the fluid compartment 66 is very high.

In the embodiment shown in FIGS. 8 and 9, the inner ridge side surface 128 and the second ridge side surface 122 are each sloped radially inwardly as they extend axially outwardly. This radially inward slope allows the second ridge side surface 122 to exert an axially outwardly and radially outwardly directed retaining force to counterbalance any axially inwardly and radially inwardly directed forces that might be encountered during operation of the fluid dispenser 10. The axially outwards directed retaining force helps to prevent the sealing disc 70 from being deflected axially inwardly towards the open position when there is a high fluid pressure within the fluid compartment 66.

As can be seen in FIG. 8, when the sealing disc 70 is at the closed position, the sealing disc 70 slopes axially inwardly as it extends radially outwardly towards the outer ridge side surface 132. As the sealing disc 70 deforms axially inwardly towards the open position, the sealing disc 70 flattens out, which increases the outer circumference of the disc 70 and moves the inner ridge side surface 128 radially outwardly relative to the second ridge side surface 122. This radially outwards movement of the inner ridge side surface 128 allows the inner ridge side surface 128 to disengage from the second ridge side surface 122 when the fluid pressure within the fluid compartment 66 is low, and thus allows the sealing disc 70 to deflect towards the open position to allow the fluid to flow axially inwardly therepast.

It will be understood that, although various features of the invention have been described with respect to one or another of the embodiments of the invention, the various features and embodiments of the invention may be combined or used in conjunction with other features and embodiments of the invention as described and illustrated herein.

The fluid dispenser 10 and the valve assembly 12 are not limited to the particular constructions shown and described herein. For example, in alternative embodiments the valve assembly 12 could be constructed so that the sealing surface and the seal surface are not the same surfaces as the catching surface and the catch surface, respectively. In such embodiments, the catching surface would not necessarily need to engage with the catch surface whenever the valve forming body 18 was at the closed position. Instead, the catching surface could be spaced radially outwardly from the catch surface, with the result that the catching surface would only engage with the catch surface if the sealing disc 70 begins deforming radially inwardly towards the central opening 30. The catching surface and the catch surface could also have a discontinuous structure that allows fluid to flow therepast.

The valve assembly 12 could be arranged in any desired orientation, and may, for example, be configured for drawing the fluid upwardly, downwardly, or laterally from the fluid reservoir 202. The term "fluid reservoir" as used herein refers broadly to any source of fluid to be drawn into the fluid compartment 66, and includes any container or compartment that is upstream from the fluid compartment 66 and delivers the fluid to the fluid compartment 66 through the fluid pathway 106. Although the fluid is preferably hand cleaning fluid, such as hand soap or hand sanitizer, the dispenser 10 could be used to dispense other fluids as well, such as condiments, tooth paste, shaving foam, or hand lotion. The term "fluid" as used herein includes any flowable substance, including liquids, foams, emulsions, and dispersions.

The fluid pressure within the fluid compartment 66 may depend on a number of factors, including the viscosity of the fluid, the size and shape of the fluid compartment 66 and the fluid pathway 106, and the forcefulness with which the dispenser 10 is activated. In most manually operated embodiments, the fluid compartment 66 will not cycle through precisely the same fluid pressures with each activation. Rather, the fluid pressure will fall within a broad range of possible pressures. When the fluid pressure is within a first range of pressures, in which the fluid pressure within the compartment 66 is lower than the pressure within the fluid reservoir 202, the valve forming body 18 moves to the open position. When the fluid pressure is within a second range of pressures, in which the fluid pressure within the compartment 66 is higher than the pressure within the fluid reservoir 202, the valve forming body 18 moves to the closed position. The sealing disc 70 could move between the closed position and the open position by sliding axially or by deforming, for example. In some embodiments, the sealing disc 70 could both slide axially and deform when moving between the closed position and the open position. The degree of rigidity or flexibility of the disc 70 may be selected as desired. In the embodiments shown in FIGS. 1 to 7, the disc 70 could be flexible or rigid.

Although this disclosure has described and illustrated certain preferred embodiments of the invention, it is to be understood that the invention is not restricted to these particular embodiments. Rather, the invention includes all embodiments which are functional or mechanical equivalents of the specific embodiments and features that have been described and illustrated herein.

We claim:

1. A one-way valve assembly comprising:

a chamber forming body that at least partially defines a variable pressure fluid compartment, the chamber forming body having an opening that extends through an outer wall of the chamber forming body along an axis; and a valve forming body that extends through the opening, the valve forming body including:

an outer retaining portion that is positioned axially outwardly from the opening and engages with a retaining surface of the chamber forming body to prevent the outer retaining portion from passing axially inwardly through the opening into the variable pressure fluid compartment; and an inner sealing disc that is positioned axially inwardly from the opening, the inner sealing disc having a radially inwardly directed catching surface;

wherein a sealable pathway is defined between the chamber forming body and the valve forming body, the sealable pathway providing a path for fluid to flow from a fluid reservoir into the variable pressure fluid compartment;

wherein the inner sealing disc is movable relative to the chamber forming body between a closed position, in which a sealing surface of the inner sealing disc sealingly engages with a seal surface of the chamber forming body to close the sealable pathway, and an open position, in which the sealing surface is spaced axially inwardly and away from the seal surface of the chamber forming body to open the sealable pathway;

wherein the variable pressure fluid compartment has an internal fluid pressure that varies between a first pressure range, in which the internal fluid pressure is lower than a fluid pressure of the fluid reservoir, and a second pressure range, in which the internal fluid pressure is higher than the fluid pressure of the fluid reservoir;

wherein, when the internal fluid pressure of the variable pressure fluid compartment is in the first pressure range, a pressure differential between the variable pressure fluid compartment and the fluid reservoir forces the inner sealing disc to the open position, allowing the fluid to flow through the sealable pathway from the fluid reservoir into the variable pressure fluid compartment;

wherein, when the internal fluid pressure of the variable pressure fluid compartment is in the second pressure range, the pressure differential between the variable pressure fluid compartment and the fluid reservoir forces the inner sealing disc to the closed position, preventing the fluid from flowing through the sealable pathway from the variable pressure fluid compartment towards the fluid reservoir;

wherein the chamber forming body has a radially outwardly directed catch surface that is positioned radially outwardly from the opening; and wherein, when the inner sealing disc is at the closed position, the catching surface is positioned radially outwardly from the catch surface in radial alignment with the catch surface so that, if the catching surface were forced radially inwardly, the catch surface would engage with the catching surface to prevent the inner sealing disc from passing axially outwardly through the opening.

2. The one-way valve assembly according to claim 1, wherein the outer wall of the chamber forming body has an annular chamber ridge that is positioned axially inwardly and radially outwardly from the opening and extends coaxially about the opening, the annular chamber ridge having a radially inwardly directed first chamber side surface and a radially outwardly directed second chamber side surface, the radially outwardly directed second chamber side surface comprising the catch surface;

wherein the outer wall of the chamber forming body defines an annular chamber recess that is positioned radially outwardly from the catch surface;

wherein the inner sealing disc has an annular valve ridge that is positioned radially outwardly from the opening and extends coaxially about the opening, the annular valve ridge having a radially inwardly directed first valve side surface and a radially outwardly directed second valve side surface, the radially inwardly directed first valve side surface comprising the catching surface;

wherein the inner sealing disc defines an annular valve recess that is positioned radially inwardly from the catching surface; and wherein, when the inner sealing disc is at the closed position, the annular valve ridge is received within the annular chamber recess, with the catching surface engaged with the catch surface, and the annular chamber ridge is received within the annular valve recess.

3. The one-way valve assembly according to claim 2, wherein the inner sealing disc comprises a central portion that is positioned axially inwardly from the opening, and a distal edge portion that is positioned axially inwardly and radially outwardly from the opening, the catching surface being positioned on the distal edge portion;

wherein, if the internal fluid pressure of the variable pressure fluid compartment is in the second pressure range and the pressure differential between the variable pressure fluid compartment and the fluid reservoir begins pushing the central portion axially outwardly towards the opening, the engagement of the catching surface with the catch surface prevents the distal edge portion from being expelled axially outwardly through the opening.

4. The one-way valve assembly according to claim 3, wherein, when the internal fluid pressure of the variable pressure fluid compartment is in the first pressure range, the pressure differential between the variable pressure fluid compartment and the fluid reservoir pushes the catching surface axially inwardly and out of engagement with the catch surface.

5. The one-way valve assembly according to claim 4, wherein the sealing surface comprises the catching surface, and the seal surface comprises the catch surface.

6. The one-way valve assembly according to claim 5, wherein the catching surface is directed radially inwardly and axially outwardly, and the catch surface is directed radially outwardly and axially inwardly.

7. The one-way valve assembly according to claim 5, wherein the catching surface is directed radially inwardly and axially inwardly, and the catch surface is directed radially outwardly and axially outwardly.

8. The one-way valve assembly according to claim 7, wherein the inner sealing disc is flexible.

9. The one-way valve assembly according to claim 4, wherein the chamber forming body comprises a piston chamber forming body that receives a piston forming element therein, the piston forming element being reciprocally movable along the axis relative to the piston chamber forming body to increase or decrease a volume of the variable pressure fluid compartment;

wherein movement of the piston forming element axially outwardly relative to the piston chamber forming body reduces the volume of the variable pressure fluid compartment, which causes the internal fluid pressure to increase to the second pressure range; and wherein movement of the piston forming element axially inwardly relative to the piston chamber forming body increases the volume of the variable pressure fluid compartment, which causes the internal fluid pressure to decrease to the first pressure range.

10. The one-way valve assembly according to claim 9, wherein the fluid comprises a hand cleaning fluid.

11. The one-way valve assembly according to claim 1, wherein the valve forming body slides axially relative to the opening to move between the closed position and the open position.

12. The one-way valve assembly according to claim 1, wherein the inner sealing disc deflects axially relative to a stem portion of the valve forming body to move between the closed position and the open position.

13. The one-way valve assembly according to claim 1, wherein the inner sealing disc comprises a central portion that is positioned axially inwardly from the opening, and a distal edge portion that is positioned axially inwardly and radially outwardly from the opening, the catching surface being positioned on the distal edge portion;

wherein, if the internal fluid pressure of the variable pressure fluid compartment is in the second pressure range and the pressure differential between the variable pressure fluid compartment and the fluid reservoir begins pushing the central portion axially outwardly towards the opening, the engagement of the catching surface with the catch surface prevents the distal edge portion from being expelled axially outwardly through the opening.

14. The one-way valve assembly according to claim 1 wherein, when the internal fluid pressure of the variable pressure fluid compartment is in the first pressure range, the pressure differential between the variable pressure fluid compartment and the fluid reservoir pushes the catching surface axially inwardly and out of engagement with the catch surface.

15. The one-way valve assembly according to claim 1, wherein the sealing surface comprises the catching surface, and the seal surface comprises the catch surface.

16. The one-way valve assembly according to claim 1, wherein the catching surface is directed radially inwardly and axially outwardly, and the catch surface is directed radially outwardly and axially inwardly.

17. The one-way valve assembly according to claim 1, wherein the chamber forming body comprises a piston chamber forming body that receives a piston forming element therein, the piston forming element being reciprocally movable along the axis relative to the piston chamber forming body to increase or decrease a volume of the variable pressure fluid compartment;

wherein movement of the piston forming element axially outwardly relative to the piston chamber forming body reduces the volume of the variable pressure fluid compartment, which causes the internal fluid pressure to increase to the second pressure range; and wherein movement of the piston forming element axially inwardly relative to the piston chamber forming body increases the volume of the variable pressure fluid compartment, which causes the internal fluid pressure to decrease to the first pressure range.

18. The one-way valve assembly according to claim 1, wherein the fluid comprises a hand cleaning fluid.

19. The one-way valve assembly according to claim 2, wherein the chamber forming body comprises a piston chamber forming body that receives a piston forming element therein, the piston forming element being reciprocally movable along the axis relative to the piston chamber forming body to increase or decrease a volume of the variable pressure fluid compartment;

wherein movement of the piston forming element axially outwardly relative to the piston chamber forming body reduces the volume of the variable pressure fluid compartment, which causes the internal fluid pressure to increase to the second pressure range; and wherein movement of the piston forming element axially inwardly relative to the piston chamber forming body increases the volume of the variable pressure fluid compartment, which causes the internal fluid pressure to decrease to the first pressure range.

20. A fluid dispenser comprising the one-way valve assembly as claimed in claim 1.

* * * * *